United States Patent [19]

Gongwer et al.

[11] Patent Number: 4,834,364

[45] Date of Patent: May 30, 1989

[54] EXERCISE POLE WITH CROSS MEMBERS

[75] Inventors: Calvin A. Gongwer; Robert C. Gongwer, both of Glendora, Calif.

[73] Assignee: Innerspace Corporation, Covina, Calif.

[21] Appl. No.: 113,535

[22] Filed: Oct. 26, 1987

[51] Int. Cl.[4] ..... A63B 21/00

[52] U.S. Cl. ..... 272/93; 272/126

[58] Field of Search ..... 272/93, 126, 117, 138, 272/144

[56] References Cited

U.S. PATENT DOCUMENTS

| | | | |
|---|---|---|---|
| 2,405,024 | 7/1946 | Eynon | 272/117 |
| 3,743,284 | 7/1973 | Rhodes et al. | 272/93 X |
| 4,323,236 | 4/1982 | Szabo | 272/117 |
| 4,337,942 | 7/1982 | Sidlinger et al. | 272/144 |
| 4,502,682 | 3/1985 | Miller | 272/144 |

FOREIGN PATENT DOCUMENTS

| | | | |
|---|---|---|---|
| 94582 | 11/1897 | Fed. Rep. of Germany | 272/93 |

*Primary Examiner*—Richard J. Apley
*Assistant Examiner*—Franklin L. Gubernick
*Attorney, Agent, or Firm*—Lyon & Lyon

[57] ABSTRACT

An exercise method and device which provides increased heart rates and respiration while introducing variable resistance to the exercise through a combination of muscular resistance aided by mechanical force transference. The invention uses a force transfer member attached to a pivot assembly and cross members adjustably attached to the force transfer member to transfer the force resulting from the extension or flexion of one muscle to a force resisting the extension or flexion of another muscle.

9 Claims, 2 Drawing Sheets

EXERCISE POLE WITH CROSS MEMBERS

BACKGROUND

Field of the Invention and Prior Art

The field of the invention is exercise methods and devices.

Much of the exercise equipment available to the normal consumer desirous of staying in good physical condition and maintaining good muscle tone consists of well known barbell sets or the more modern systems of pulleys and weights arranged such that the user receives his exercise by pushing or pulling against either friction or gravity. The barbell style equipment is usually bulky because of the need to be able to increase the number of weights used for each exercise as the user achieves his goal of good muscle tone or physical conditioning. Modern weight equipment, while usually more compact, is generally quite expensive.

An alternative to the purchase of equipment by the athletically inclined person is to join an athletic club. This alternative, however, is available only to those persons living close to such a club and having the money to pay the initial fee of several hundred dollars and maintain the monthly payments.

Persons desirous of maintaining or improving their physical condition and muscle tone and unable to join an athletic club or purchase their own equipment because of money, time, distance or space requirements, has had to resort to calisthenics or isometrics. While calisthenics are very beneficial, they do not allow the exerciser to vary the resistance required to perform the excercise. For example, when performing deep knee bends, the only resistance placed on the back, leg and stomach muscles when performing the exercise, is the persons own weight. With the use of bar bells or weight machines, the user would have been able to gradually increase the resistance or load by adding weights or increasing the friction, allowing the exerciser to develop a particular set of muscles more rapidly.

Isometric exercises, while very covenient for the upper extremities, are difficult to perform on the lower extremities and back. Furthermore, isometric exercises focus on one particular muscle at a time and generally do not result in a sustained increase in heart rate or respiration as can be achieved through calisthenics or exercise machines because of the suggested short duration of isometric exercises.

SUMMARY OF THE INVENTION

The exercise method and device of the present invention provides the increased heart rates and respiration of calisthenics, while introducing variable resistance to the exercise through a combination of muscular resistance aided by mechanical force transference. The present invention accomplishes this through the use of a force transfer member attached to a pivot assembly and cross members adjustably attached to the force transfer member which act to transfer the force resulting from the extension or flexion of one muscle to a force resisting the extension or flexion of another muscle.

DETAILED DESCRIPTION OF THE DRAWINGS

Figure 4A:
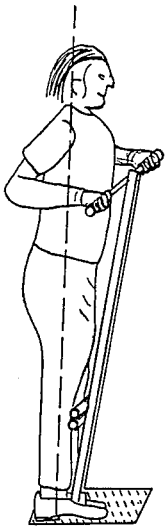
Figure 4B:
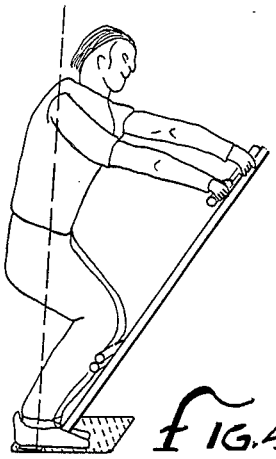

FIGS. 4*a* and 4*b* depict the first position and the second position, respectfully, for performing one method of using the exercise device of the present invention.

Figure 5A:
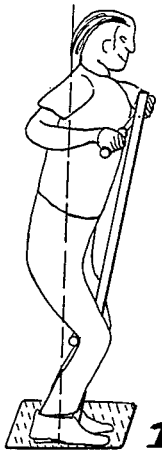
Figure 5B:
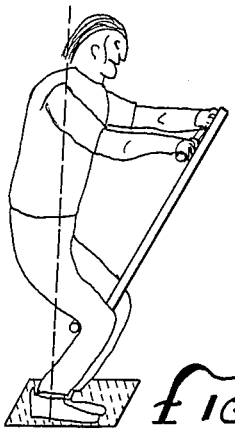

FIGS. 5*a* and 5*b* depict the first position and the second position, respectfully, for performing a second method of using the exercise device of the present invention.

DETAILED DESCRIPTION OF THE DRAWINGS

Figure 1:
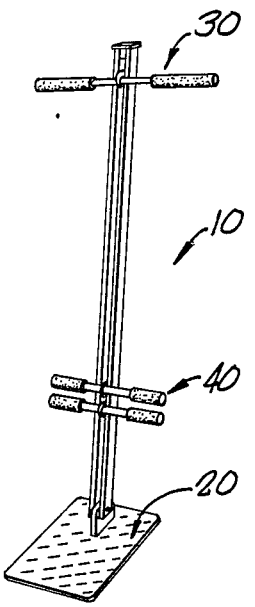
FIG. 1 is a perspective view of the preferred embodiment of the present invention.
Figure 2:
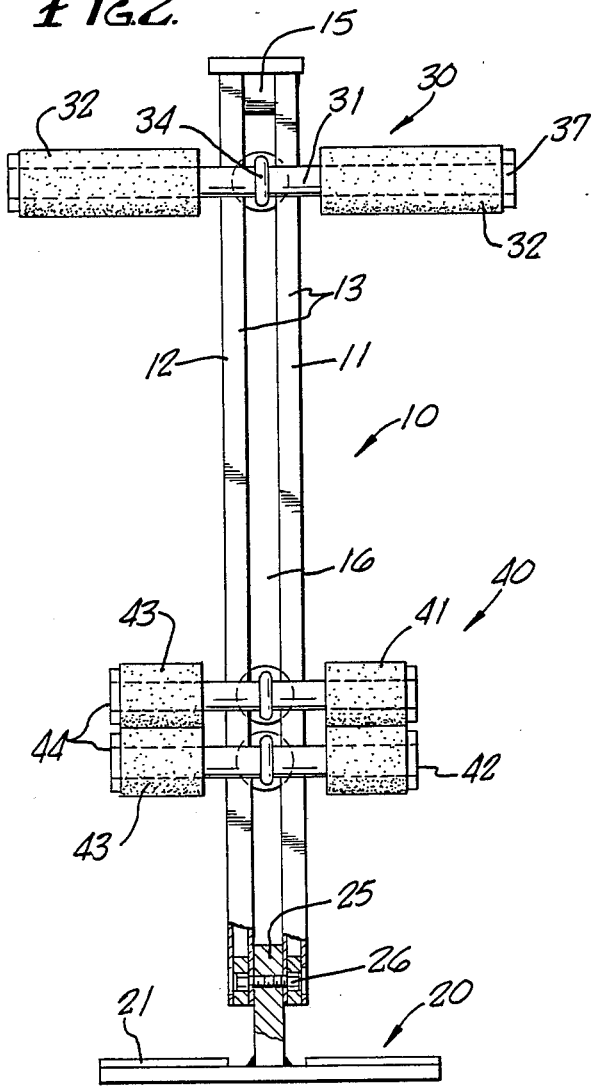
FIG. 2 is a front view of the preferred embodiment of the present invention.
Figure 3:
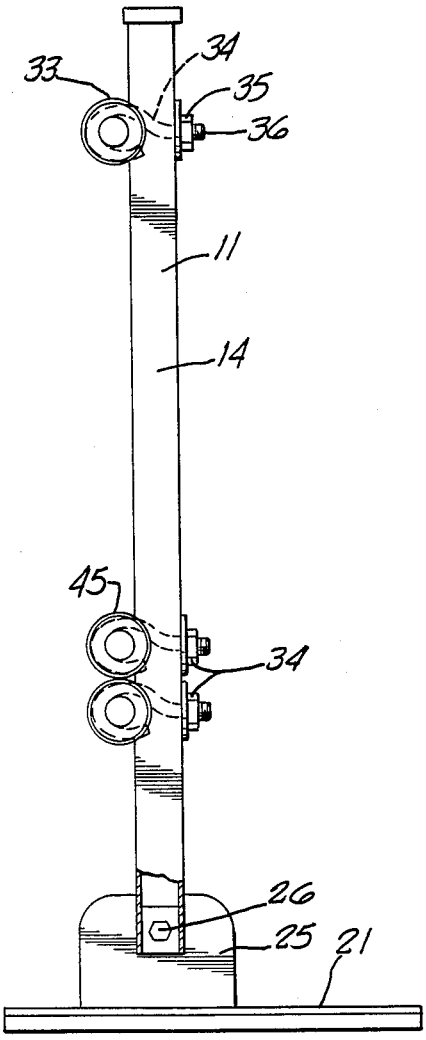
FIG. 3 is a side view of the preferred embodiment of the present invention.

As seen in FIGS. 2 and 3, in the preferred embodiment a force transfer member 10 is attached to a pivot assembly 24. The force transfer member 10 is comprised of first and a second rectangular tube, 11 and 12 respectively. Each tube has a narrow face 13 and wide face 14. When looking at the tube in cross section, the wide face is the length and the narrow face is the width. The tubes are arranged parallel to one another with the wide faces 14 facing each other. The rectangular tubes 11 and 12 are spaced a distance apart by a spacer 15 at one end of the tubes 11 and 12, creating a longitudinal slot 16. An end plate 17 is attached to the end of the tubes 11 and 12 at the same end as the spacer 15. To keep the weight of the force transfer member 10 at a minimum, the rectangular tubes 11 and 12 and the spacer 15 are constructed of aluminum.

The force transfer member 10 is attached to the pivot assembly 24 at a single point of attachment. The pivot assembly of the preferred embodiment is comprised of a pivot plate 25 and a pin 26. The pivot plate 25 is welded in an upright manner along the lengthwise centerline of the base plate 20 a distance approximately one third of the length of the base plate 20 from one end of the base plate 20. The pivot assembly 24 may be mounted or attached to either the floor or a base plate provided that it is restrained from movement during use. The pivot plate 25 is inserted between the rectangular tubes 11 and 12 in the longitudinal slot 16 and secured by pin 26. The pin 26 comprises an allen bolt and a nut with a nylon insert and an antirotation block 27 to prevent the pin 26 from inadvertently coming loose during use while at the same time providing for ease of assembly. Furthermore, the pivot assembly is sufficiently resistive to movement to allow the force transfer member 10 to remain substantially vertical when not in use, yet loose enough to move when being used. In the preferred embodiment, this is controlled by the adjustment of the nut. Again, to keep weight at a minimum, the pivot plate 26 is constructed of aluminum.

The base plate 20 includes a textured non-skid surface and an antislip pad 21 to assist in preventing the exerciser's feet from slipping while performing the exercise method of this invention. The base plate 20 is constructed of one quarter inch aluminum plate.

A first cross member 30 is adjustably attached to the force transfer member 10. The first cross member is comprised of a cross bar 31 and includes hand grips 32. The hand grips 32 are freely rotatable about the cross bar 31 and maintained on the cross bar by means of a cap 37. The hand grips 32 are protected by a nylon cover 33. The nylon covers 33 are attached by means of a Velcro TM fastener.

The attachment means for allowing a wide range of adjustment of the cross member 30 along the length of the force transfer member 10, is comprised of a threaded hook-eye 34. The cross bar 31 of the cross member 30 passes through the hook-eye of the threaded hook-eye 34 and is welded in place. The threaded end of the threaded hook-eye 34 is passed through the slot 16 and held in place by means of a washer 35 and a nut 36. Loosening of the nut 35, which can be a hand-tightenable wing nut or tool-tightenable hex nut, allows the cross member 30 to be adjusted to the appropriate height to afford the most benefit to the user.

A second cross member 40 is adjustably attached to the force transfer member 10 between the base plate 20 and the first cross member 30. For maximum versatility the second cross member 40 is comprised of a first and second cross bar 41 and 42, respectively. The first and second cross bars 41 and 42 each have shin pads 43 attached to allow free rotation around the cross bars. The shin pads 43 are kept in place by end caps 44. A nylon cover 45 protects the shin pads 43 and is attached by means of a Velcro TM fastener.

The first and second cross bars 41 and 42 are adjustably attached to the force transfer member 10 by means of threaded hook-eyes 34. The cross bars 41 and 42 pass through the hook-eye and are welded in place at their midsection. The threaded portions of the threaded hook-eyes 34 pass through the slot 16 and are held in place by a nut 35 and a washer 36. Again, the nut 35 can be either a hand-tightenable wing nut or a tool-tightenable hex nut.

The exercise device is most profitably used in one of two methods. These methods of use are generally depicted in FIGS. 4 and 5. In one method shown in FIG. 4, the user begins in the upright position as shown in FIG. 4*a* by grasping the first cross member, pressing his shins against the second cross member and then simultaneously resistively extending the arms while still grasping the first cross member and bending at the knee keeping the shins forcefully pressed against the second cross member causing the force transfer member to swing about the pivot assembly and transfer the pushing force created by the leg muscles to the resistive force created by the arm muscles and vice versa to end up in the squat position shown in FIG. 4*b*. The extending/bending step is repeated as desired.

Similarly, in another method of using the device, which is shown in FIG. 5, the user begins in the upright position of FIG. 5*a* by grasping the first cross member, placing the second cross member at the upper calf and then simultaneously extending the arm by pushing against the first cross member with the arm muscles while still grasping the first cross member and resistively bending at the knee with the second cross member kept pressed against the calf causing the force transfer member to swing about the pivot assembly and transfer the pushing force created by the arm muscles to the resistive force of the leg muscles and vice versa to end up in the squat position of FIG. 5*b*. Again the extending/bending step is repeated as desired.

The preferred method of using the exercise device shown in FIG. 4, comprises the steps of standing on the base plate 20 with one foot placed on each side of the force transfer member 10 which is attached to the base plate 20 by the pivot assembly 24. Grasping the hand grips 32 which are attached around each end of the cross bar 31 of the first cross member 30 which is attached substantially perpendicular to the force transfer member 10 with each hand. Placing each shin against a shin pad 43 which is attached to each end of the cross bar 41 of the second cross member 40 which is attached substantially perpendicular to the force transfer member 10 between the first cross member 30 and the base plate 20. Once in this position, simultaneously bending at the knee in the same way one would bend when beginning to sit down by pushing against the shin pads 43 with the leg muscles and resistively extending the arms. The shins should be kept forcefully pressed against the second cross member 40 and the hand grips should not be released. The back should be kept substantially straight during the exercise. The pushing with the leg muscles while bending the knee and the simultaneous pulling back on the first cross member 30 with the arms (which creates variable resistance to the bending action through the force transfer member 10) should be repeated a sufficient number of times to obtain a slight increase in the heart and respiration rates, consistent with the physical condition of the user and the advice of a physician.

For the most advantageous use of the exercise device, the steps of initially adjusting the location of the first cross member 30 to a position wherein the first cross member 30 is substantially aligned with the users chest and adjusting the location of the second cross member 40 to a position wherein the second cross member 40 is substantially aligned to a position just below the users knee cap, should be included. Additionally, it has proven advantageous when using the device as just described, to have the second cross member 40 comprised of two cross bars 41 and 42. The first cross bar 41 should be adjusted to a position just under the users knee cap and the second cross bar 42 should be adjusted to a location half way between the knee cap and the ankle.

Another preferred method for beneficially using the exercise device shown in FIG. 5, comprises all of the steps of the first method except that rather than placing the shins against the second cross member 40, the user places the calves against the second cross member 40. Also, in this position the arm muscles push against the resistance of the leg muscles rather than pulling against them.

Accordingly, the preferred exercise method and device of the present invention has been described. While various embodiments have been described pointing out the novelty and usefulness of the device, as would be apparent to those skilled in the art to which this invention is directed many more embodiments and applications of the invention are possible without deviating from the scope of the invention. The invention therefore should not be restricted except in accordance with the claims set forth below.

We claim as follows:

1. An apparatus comprising a base means with an attached pivot assembly a force transfer member comprising a free end and an attachment end;

said force transfer member being attached at said attachment end to said pivot assembly at a point of attachment, said force transfer member being freely moveable about said point of attachment, said free end of said force transfer member having the ability to trace an arc about said point of attachment;

a first cross member adjustably attached to said force transfer member, whereby said first cross member can be fixedly attached at any point between the ends of said force transfer member;

a second cross member adjustably attached to said force transfer member in a relationship with said first cross member wherein movement of said force transfer member about said pivot assembly causes said first cross member to trace a larger arc about said pivot assembly than said second cross member; and whereby said second cross member can be fixedly attached at any point between the ends of said force transfer member.

2. An apparatus of claim 1 wherein said pivot assembly is attached to a base plate.

3. An apparatus of claim 2 wherein said pivot assembly comprises a pivot plate having a through hole, a pin and a means for securing said pin in said through hole; said pivot plate is attached perpendicular to said base plate and formed so as to be received in a longitudinal slot in said force transfer member; said force transfer member having through holes for receiving said pin when said through hole of said pivot plate is aligned with said through holes of said force transfer member; said pin extending through said through holes and secured in place by said securing means.

4. An apparatus of claim 1 including a hand grip attached to said first cross member.

5. An apparatus of claim 1 includes a pad attached to said second cross member.

6. An apparatus of claim 1 wherein said second cross member comprises a first and second cross bar each separately attached to said force transfer member, said first and second cross bar each being independently adjustable to be fixedly attached at any point along the length of said force transfer member between said free end and said attachment end.

7. An apparatus comprising a pivot assembly including at least one point of attachment;

a force transfer member comprising a free end and an attachment end;

said force transfer member being attached at said attachment end to said pivot assembly at said point of attachment, said force transfer member being freely moveable about said point of attachment, said free end of said force transfer member having the ability to trace an arc about said point of attachment;

a first cross member adjustably attached to said force transfer member, said first cross member can be fixedly attached at any point between the ends of said force transfer member;

a second cross member adjustably attached to said force transfer member in a relationship with said first cross member wherein movement of said force transfer member about said pivot assembly causes said first cross member to trace a larger arc about said pivot assembly than said second cross member; and whereby said second cross member can be fixedly attached at any point between the ends of said force transfer member;

said pivot assembly is attached to a base plate and said base plate includes a non-skid surface.

8. An exercise apparatus comprising a base plate;

a force transfer member comprising a free end and an attachment end;

a pivot assembly attached to said base plate and said force transfer member at said attachment end, said force transfer member being freely moveable about said pivot assembly in a plane perpendicular to said base plate;

a first cross member adjustably attached substantially perpendicular to said force transfer member, whereby said first cross member can be fixedly attached at any point between the ends of said force transfer member;

at least one hand grip attached to said cross member;

a second cross member adjustably attached substantially perpendicular to said force transfer member between said first cross member and said base plate whereby said second cross member can be fixedly attached at any point between the ends of said force transfer member at least one shin pad attached to said second cross member; and, a position maintaining means for allowing said force transfer member to remain substantially vertical when said base plate is horizontal.

9. An apparatus comprising a pivot assembly including at least one point of attachment;

a force transfer member comprising a free end and an attachment end;

said force transfer member being attached at said attachment end to said pivot assembly at said point of attachment, said force transfer member being freely moveable about said point of attachment, said free end of said force transfer member having the ability to trace an arc about said point of attachment;

a first cross member adjustably attached to said force transfer member, said first cross member can be fixedly attached at any point between the ends of said force transfer member;

a second cross member adjustably attached to said force transfer member in a relationship with said first cross member wherein movement of said force transfer member about said pivot assembly causes said first cross member to trace a larger arc about said pivot assembly than said second cross member; and whereby said second cross member can be fixedly attached at any point between the ends of said force transfer member;

said pivot assembly is attached to a base plate;

said pivot assembly comprises a pivot plate having a through hole, a pin and a means for securing said pin in said through hole; said pivot plate is attached perpendicular to said base plate and formed so as to be received in a longitudinal slot in said force transfer member; said force transfer member having through holes for receiving said pin when said through hole of said pivot plate is aligned with said through holes of said force transfer member; said pin extending through said through holes and secured in place by said securing means; and, said securing means comprises a nut with a nylon insert threaded onto said pin and an anti-rotation block capturing said nut and secured to said force transfer member preventing rotation of said nut with respect to said force transfer member.

* * * * *